US009555445B1

(12) United States Patent
Davis et al.

(10) Patent No.: US 9,555,445 B1
(45) Date of Patent: Jan. 31, 2017

(54) ROTATING SUCTION CHAMBER APPARATUS

(71) Applicants: Nicholas Davis, San Diego, CA (US); Robert Davis, Jamul, CA (US)

(72) Inventors: Nicholas Davis, San Diego, CA (US); Robert Davis, Jamul, CA (US)

(73) Assignee: CP Manufacturing, Inc., San Diego, CA (US)

( * ) Notice: Subject to any disclaimer, the term of this patent is extended or adjusted under 35 U.S.C. 154(b) by 0 days.

(21) Appl. No.: 14/797,093

(22) Filed: Jul. 11, 2015

(51) Int. Cl.

| | |
|---|---|
| ***B07B 9/00*** | (2006.01) |
| ***B07B 4/06*** | (2006.01) |
| ***B07B 9/02*** | (2006.01) |
| *B07B 4/02* | (2006.01) |
| *B07B 1/22* | (2006.01) |

(52) U.S. Cl.
CPC . *B07B 4/06* (2013.01); *B07B 9/02* (2013.01); *B07B 1/22* (2013.01); *B07B 4/025* (2013.01)

(58) Field of Classification Search
CPC ..... B07B 1/22; B07B 1/24; B07B 4/02; B07B 4/025; B07B 4/06; B07B 4/08; B07B 9/00; B07B 9/02
USPC ..... 209/643
See application file for complete search history.

(56) References Cited

U.S. PATENT DOCUMENTS 2,236,548 A * 4/1941 Prouty ..... B02C 17/189 131/302
3,409,025 A * 11/1968 Wochnowski ..... A24B 3/04 131/303
3,756,406 A * 9/1973 Khan ..... B07B 1/24 209/291
4,261,816 A * 4/1981 Beck ..... A23N 17/00 209/284
4,312,749 A * 1/1982 Bingham ..... B03B 5/56 209/298
4,461,428 A * 7/1984 Williams ..... B02C 21/00 241/34
5,427,250 A * 6/1995 Page ..... B07B 1/005 209/284
6,220,446 B1 * 4/2001 Witt ..... B07B 1/24 209/240
6,951,285 B1 * 10/2005 Anderson ..... B07B 4/02 209/143
7,051,880 B1 * 5/2006 Bills ..... B07B 7/01 209/147
8,016,117 B2 * 9/2011 Althouse ..... B07B 4/02 209/139.1

(Continued)

*Primary Examiner* — Joseph C Rodriguez
(74) *Attorney, Agent, or Firm* — Manuel de la Cerra

(57) ABSTRACT

A rotating suction chamber apparatus for sorting a mixture of materials comprises a cylindrical drum with its upper end is at a higher elevation than its lower end. An upper housing connected to the upper end has a material intake for receiving the mixture of materials for introduction to the upper end. The mixture of materials includes a light fraction and a heavy fraction, and the upper housing has an outlet for the light fraction. A suction hood connected to the light fraction outlet includes a light separator shaft with a substantially vertical portion, and an air blower is adapted to create an airflow from the lower end, to the upper end, through the light fraction outlet and through the suction hood. A rotator rotates the drum about its longitudinal axis so that the heavy fraction is moved through the drum and falls out of the lower end.

8 Claims, 9 Drawing Sheets

(56) References Cited

U.S. PATENT DOCUMENTS

| | | | | |
|---|---|---|---|---|
| 8,091,711 | B2 * | 1/2012 | Hsiau | B07B 1/22 209/284 |
| 8,517,177 | B2 * | 8/2013 | Graham | B03B 9/061 209/12.1 |
| 2007/0074998 | A1 * | 4/2007 | Langner | B07B 1/22 209/284 |
| 2015/0231668 | A1 * | 8/2015 | Bosco De Barros | B07B 4/08 209/22 |
| 2016/0045936 | A1 * | 2/2016 | Davis | B07B 1/22 209/288 |

* cited by examiner

ROTATING SUCTION CHAMBER APPARATUS

1.0 TECHNICAL FIELD

The present invention relates generally to machines used to separate particulate materials or mixed recyclable materials into difference fractions, and more particularly, to air separators.

2.0 RELATED APPLICATIONS

This application is also related to U.S. Patent Application 62/037,038 filed on Aug. 13, 2014, converted to non-provisional application Ser. No. 14/797,088 filed on Jul. 11, 2015; U.S. Patent Application 62/153,901 filed on Apr. 28, 2015, converted to non-provisional application Ser. No. 14/797,090 filed on Jul. 11, 2015; and U.S. Patent Application 62/160,219 filed on May 12, 2015; all of which are assigned to the same assignee and have a common inventor with the present application. Each of these applications is incorporated herein by reference.

3.0 BACKGROUND

Air separation is the most effective method for cleaning shredded paper out of glass cullet, a situation which often arises in single-stream recyclable processing plants. Yet modern air separation devices suffer from several potential hazards. First, there is a potential for material to bridge, clog, or otherwise jam the suction chamber, causing downtime. Second, a lack of dwell time within the separation area results in reduced separation efficiency and increased sensitivity to material surge and layering. Third, a sensitivity to material orientation, rather than to specific gravity, causes a reduction in separation efficiency. A final hazard is that some material, especially wet material, tends to stick together as a composite and not be separated.

The first type of hazard typically occurs in suction chambers, where material is dropped through a flow of air produced by a vacuum. These types of devices usually have chutes, plates, or other devices to contain and restrict the airflow, because air takes substantial energy to move in high volumes. Straight drop-out chambers and zig-zag chambers are susceptible to this hazard. Because the cross-sectional area of the separation chamber is small, the device can jam on large items or "divers" (e.g. rebar and sticks) in the fines fraction. The large items bridge the chamber and other items build up on top of the bridge. Potential throughput is also small due to the small chamber.

In response, "air knife" style air separators were developed. Rather than pull the light components (e.g. shredded paper) through a vacuum system, a blower is used to generate a knife of air that pushes the light components forward while the heavy components (e.g. glass) fall through, as for example, in Westeria, Nihot and Walair drum-style separators. While this largely solves the jamming and throughput issues that exist with suction chambers, these air knife separators suffer from the second and third hazards described above. Because it uses only a thin knife of air, this type of machine has a single opportunity to separate the materials, rather than the several seconds or bounces that occur in suction chambers. Thus a large item, such as a rock, on top of a light item, such as a piece of paper, will push the light item through the knife of air and improperly sort it into the heavy components. This effect is particularly acute during "surges" of material, where a large clump of items will bind together and act like a heavy component as the air knife is not strong enough to push it in the desired direction. For the same reason, when wet or sticky materials clump together the air knife cannot separate them due to the absence of material agitation.

Further, the air knife concept acts not as a specific gravity separator, but as a separator based on the ratio of weight to cross sectional area of the item perpendicular to the air flow. For example, a large, flat, heavy item, such as a plate, can either catch the air stream on its broad face and be pushed over or "Frisbee" on top of the air stream, reducing separation efficiency. In a mixed waste stream, items are of extremely variable shape, reducing the separation efficiency of air knives.

FIGS. 7, 8 and 9 depict other prior art approaches that introduce the material in the middle part of a rotating drum. These devices, however, have several of the same disadvantages described above. First, because the material is introduced mid-drum, the light fraction is in immediate contact with the heavy fraction within the drum, allowing the light fraction to either stick to the heavy fraction or wrap around the heavy fraction, causing the light fraction to be improperly sorted. Second, the air circulation is open, which blows potentially solid waste particulate that may contain biohazard (bio-aerosols) and other hazards such as glass dust into the atmosphere. Third, the drum operates as the sole separation device such that once material leaves the upper part of the drum, it is no longer sorted. This limits the efficiency by not giving the apparatus a chance to correct a mis-sorted fraction, and by not proving a way of sorting for a medium fraction.

Another sorting strategy is a suction hood placed above a material stream. While this solves the jamming issue of a separation chamber, it tends to be of low efficiency for same reasons recited above for air knives.

Thus there is a need in the art for a sorting apparatus which addresses the above issues.

4.0 SUMMARY

One or more aspects of the rotating suction chamber described herein address the need in the art for a sorting apparatus which avoids such hazards as jamming, lack of dwell time, surge, clumping, and sensitivity to orientation.

In accordance with one embodiment, an inclined cylindrical drum receives though a housing at its upper end a mixture of materials composed of light and heavy fractions. A suction hood above the upper end lifts the light fraction through a substantially vertical portion of a light separator shaft as an air blower creates an airflow from the lower end of the drum to the upper end. A rotator turns the drum about its longitudinal axis, causing the heavy fraction to move through the drum and fall out of the lower end. The drum may have a plurality of flights, which may be helical, for separating the light fraction from the heavy fraction as the drum is rotated. A separator may also be used to separate the light fraction from the airflow, delivering it to a light fraction receptacle, and exhausts air to an air recirculation shaft, thereby allowing the airflow to circulate in a closed loop. Gate valves may facilitate the airflow and prevent material from being blown out. Another embodiment allows for the separation of a medium fraction from the mixture of materials.

Advantages of one or more aspects over the prior art are as follows. Jamming is prevented because any material which attempts to bridge within the chamber will immediately be lifted out of the bridging orientation. Because static chutes are not used, material cannot linger and build up. Further, with a declined angle of the barrel, the material can be made to dwell within the barrel for a set amount of time. The barrel can be set at a lower angle than static suction chambers because the rotation of the barrel moves material through the barrel. This results in multiple opportunities to sort each item appropriately, increasing separation efficiency. Because items are repeatedly lifted within the barrel and dropped though the air stream, composites can be broken apart for sorting, and layered items, such as the rock and paper above, become unlayered. As items dwell within the chamber, any surge is slowly decayed by the machine. Lastly, items are continuously moved in orientation relative to the air, so a more true specific gravity separation can occur.

Other advantages of one or more aspects will be apparent from consideration of the drawings and following description.

5.0 BRIEF DESCRIPTION OF THE DRAWINGS

Various aspects of certain example embodiments can be better understood with reference to the following figures. The components shown in the figures are not necessarily to scale, emphasis instead being placed on clearly illustrating example aspects and features. In the figures, like reference numerals designate corresponding parts throughout the different views and embodiments. Certain components and details may be omitted from the figures to improve clarity.

Figure 7:
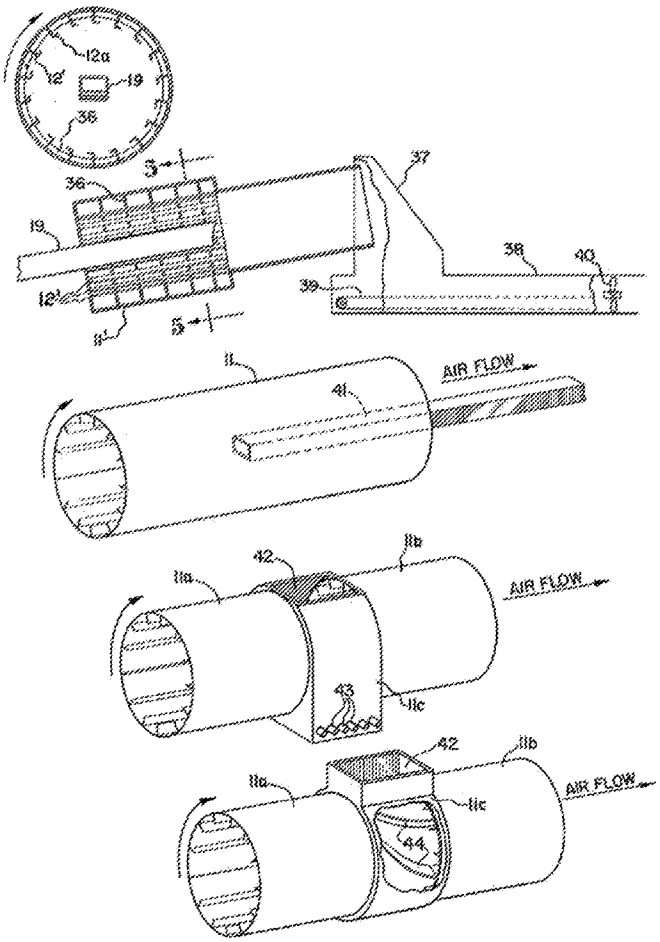
FIG 7 (Prior Art)

FIG. 7 is perspective views of a prior art (U.S. Pat. No. 3,804,249) rotating air drum sorter.

Figure 8:
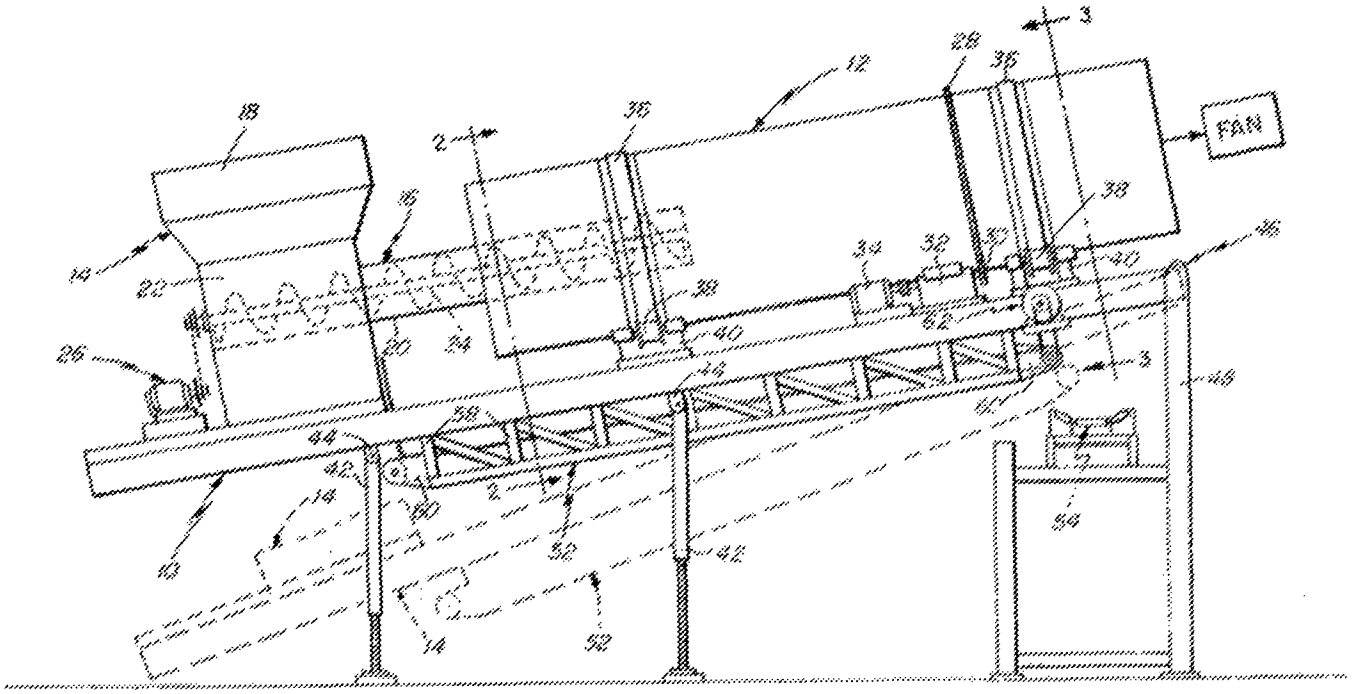
FIG 8 (Prior Art)

FIG. 8 is an elevation view of a prior art (U.S. Pat. No. 3,957,629) rotary drum air classifier.

Figure 9:
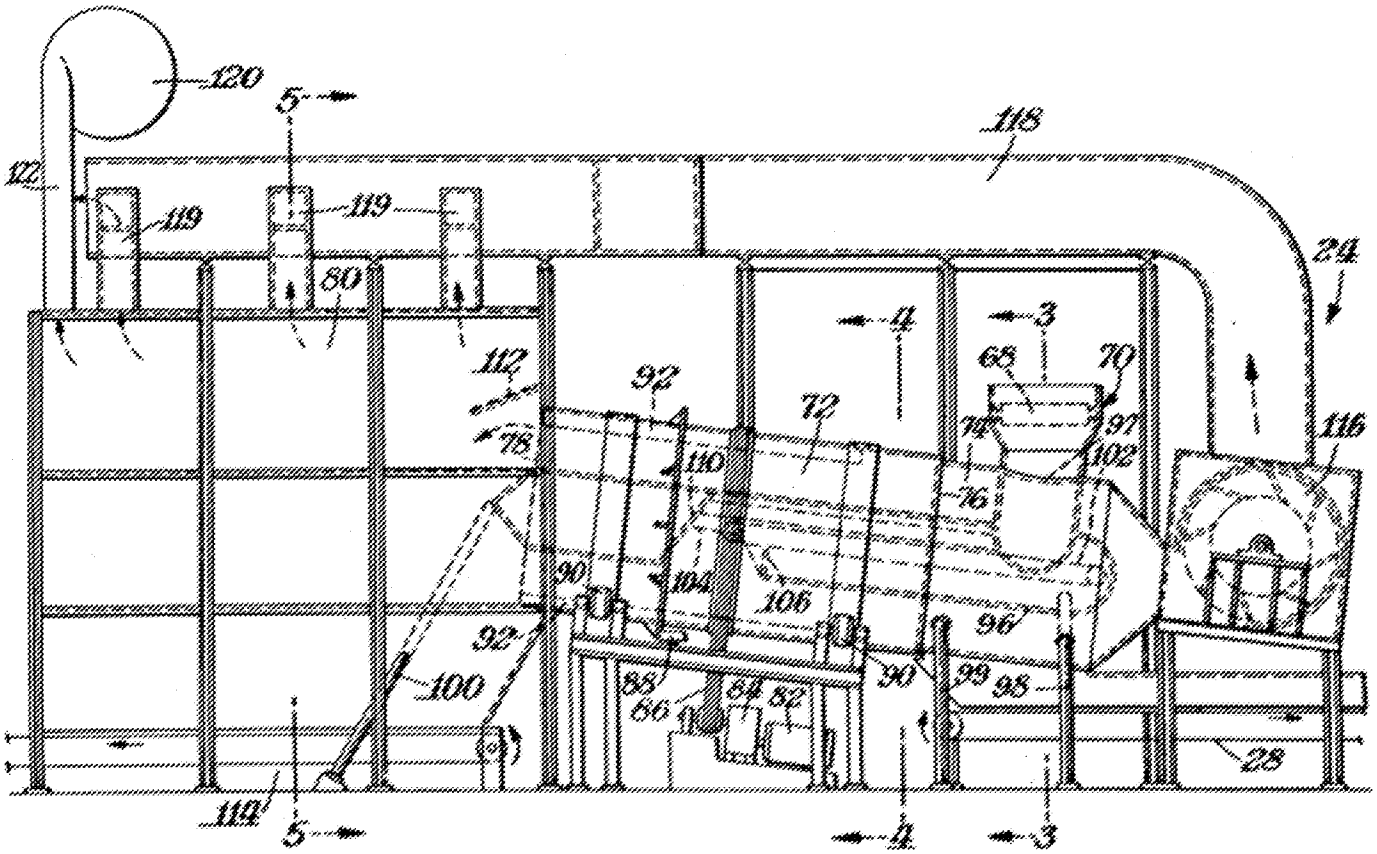
FIG 9 (Prior Art)

FIG. 9 is a side view of a prior art (U.S. Pat. No. 5,022,982) drum solid waste air classifier.

6.0 DETAILED DESCRIPTION OF EXAMPLE EMBODIMENTS

Following is a written description illustrating various aspects of non-limiting example embodiments. These examples are provided to enable a person of ordinary skill in the art to practice the full scope of the invention, including different examples, without having to engage in an undue amount of experimentation. As will be apparent to persons skilled in the art, further modifications and adaptations can be made without departing from the spirit and scope of the invention, which is limited only by the claims.

In the following description, numerous specific details are set forth in order to provide a thorough understanding. Particular example embodiments may be implemented without some or all of the disclosed features or specific details. Additionally, to improve clarity of the disclosure, some components well known to persons of skill in the art are not described in detail.

Figure 1:
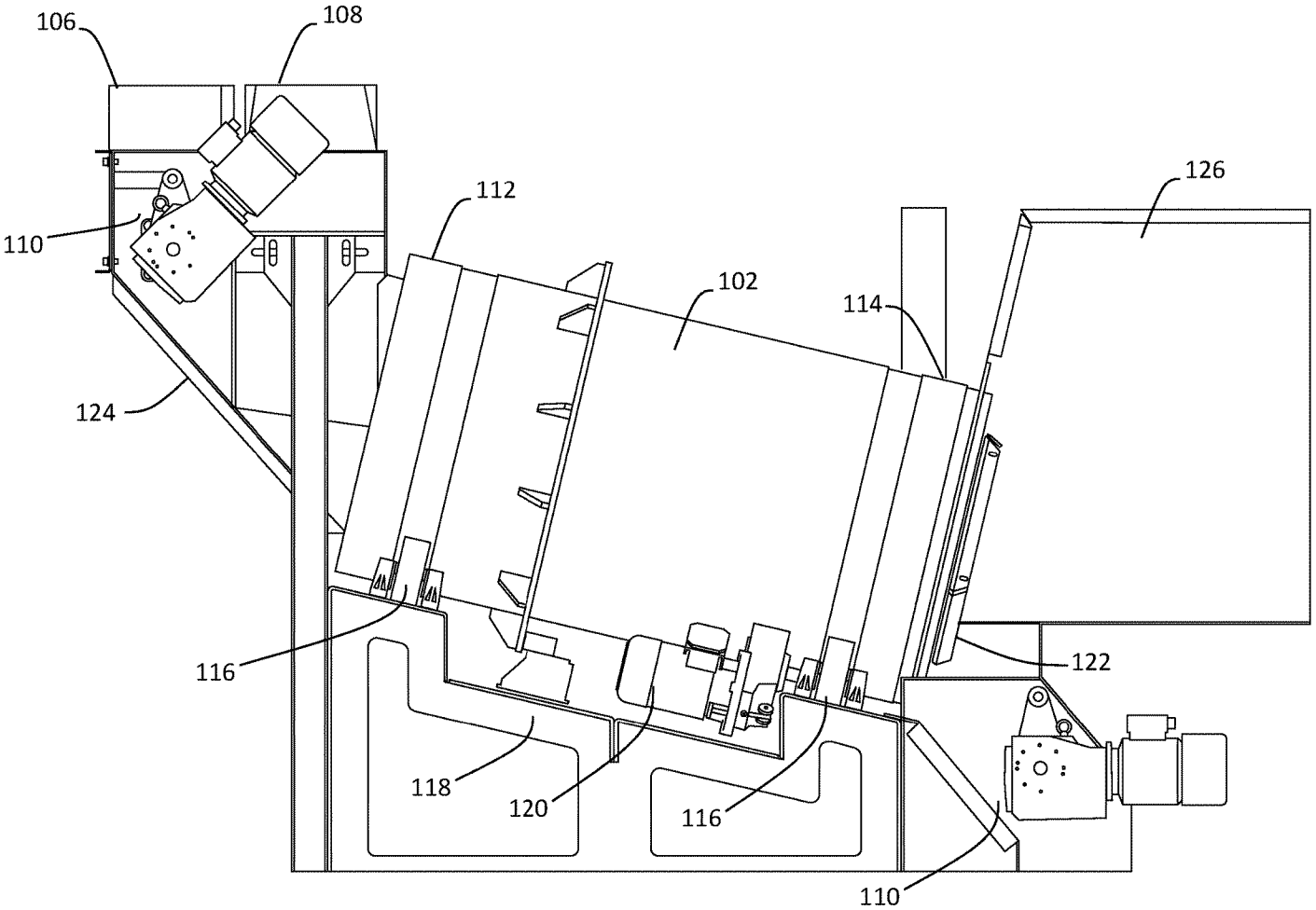
FIG. 1 is a side view of the drum region of the rotating suction chamber apparatus with panels hidden.

The reference numerals and numbers refer to the following structures or features of the present disclosure:

102 drum
106 unsorted material intake
108 light fraction outlet
110 gate valve
112 upper end of drum
114 lower end of drum
116 wheels
118 drum supporting structure
120 motor
122 heavy fraction outlet
124 upper housing
126 lower housing
202 flights
204 drum inner wall
502 conical separator
504 air recirculation shaft
506 light fraction receptacle
508 air blower
510 conical separator intake
512 conical separator exhaust
514 light separator shaft
516 suction hood
518 material feed
606 seal ring
608 medium fraction outlet
610 air lock
612 seal plate
614 air gate
616 last chance suction gate
618 light fraction
620 heavy fraction Referring to FIG. 1, an embodiment of the rotating suction chamber apparatus includes a cylindrical drum 102 which is oriented on an incline with the upper end 112 at a higher orientation that the lower end 114. The supporting structure 118 maintains the drum 102 in an inclined orientation. The wheels 116 are driven by a motor 120 to rotate the drum 102 about its longitudinal axis. An upper housing 124 attaches to the upper end 112 and includes an unsorted material intake 106 and a light fraction outlet 108. A lower housing 126 attaches to the lower end 114 and includes a heavy fraction outlet 122. Both the upper housing 124 and lower housing 126 incorporate a gate valve 110.

Figure 2:
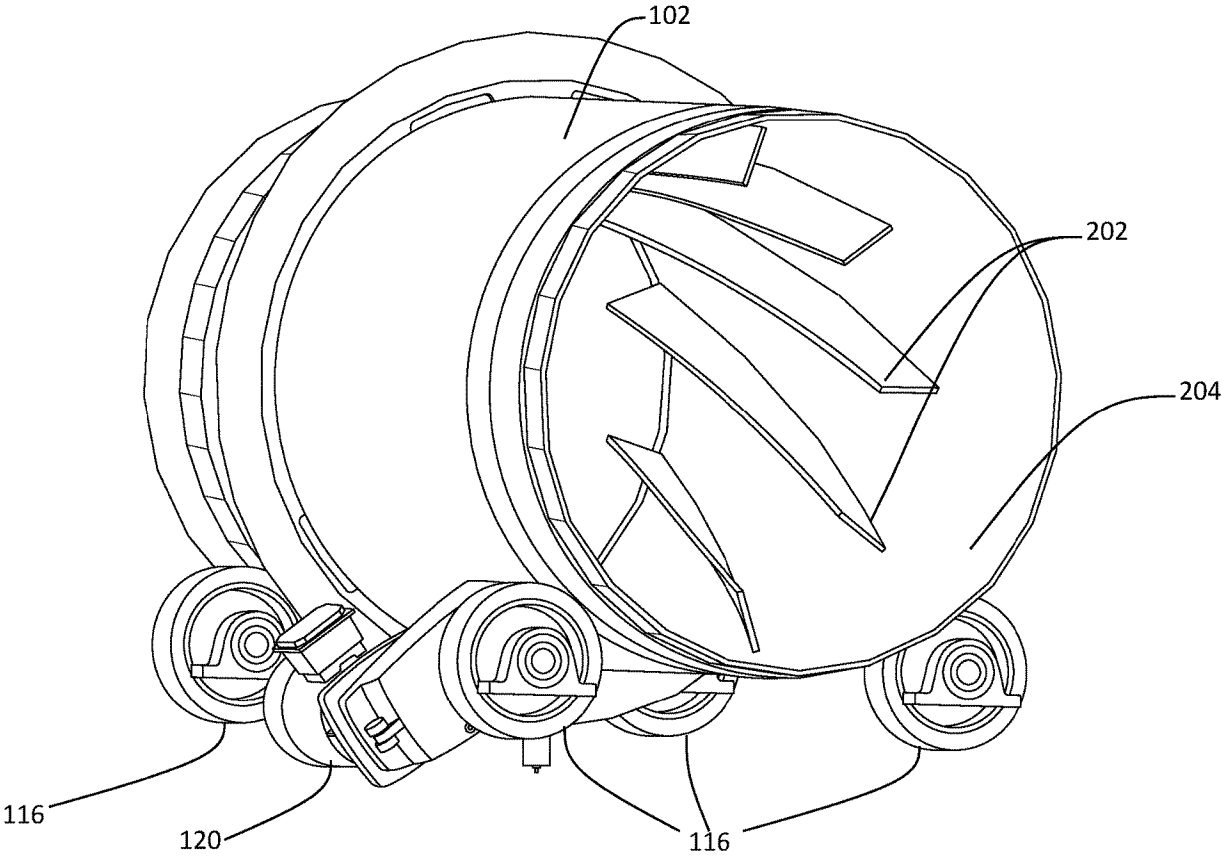
FIG. 2 is a side view of the drum.
Figure 3:
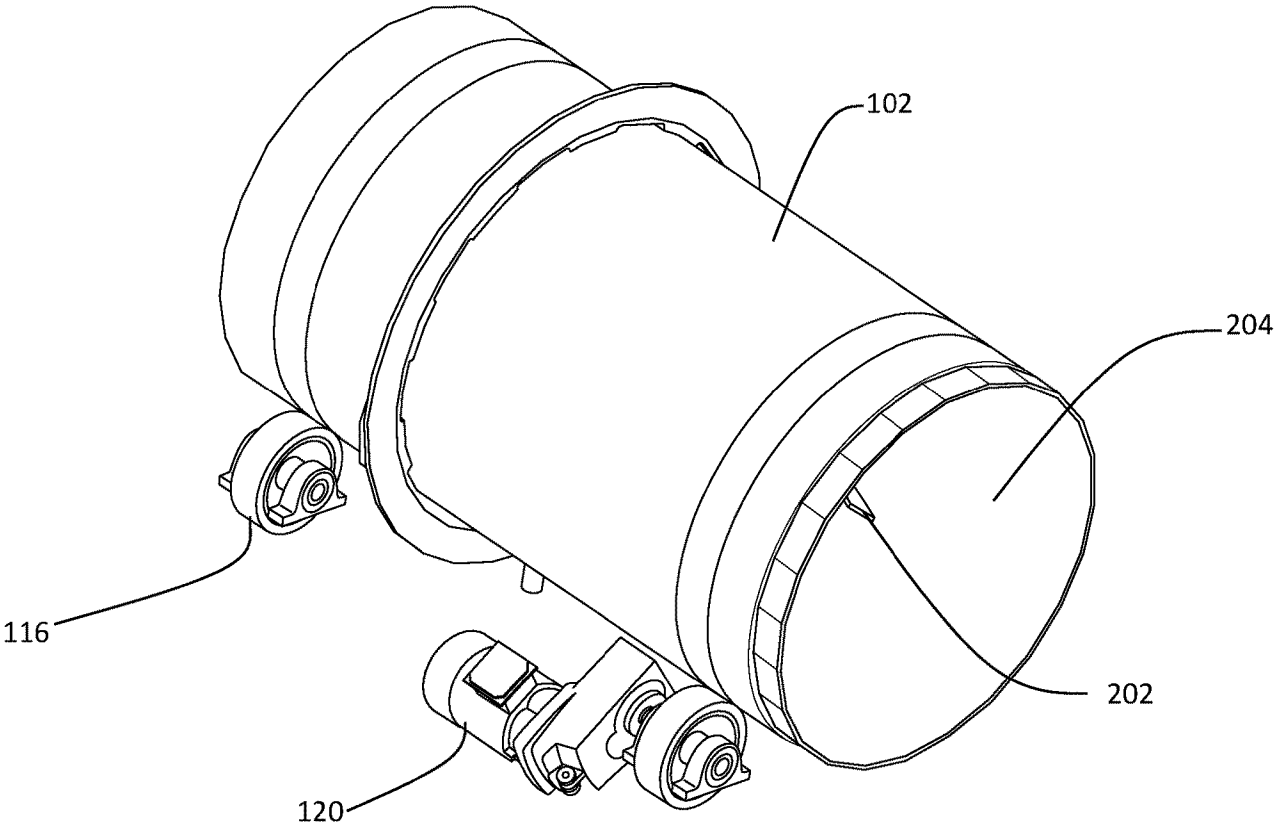
FIG. 3 is an isometric view of the drum.
Figure 4:
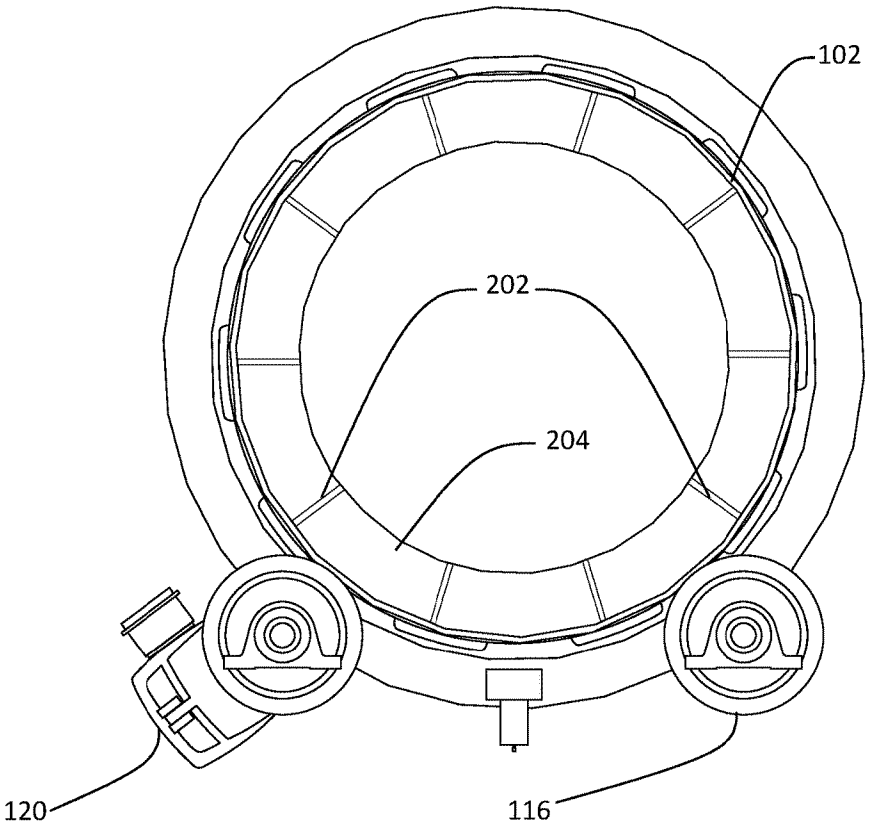
FIG. 4 is a front view of the drum.

FIGS. 2, 3 and 4 show the interior of the drum 102 which has a plurality of flights 202 on the inner wall 204. The flights 202 may be helical to aid in separating items as the drum is rotated.

Figure 5:
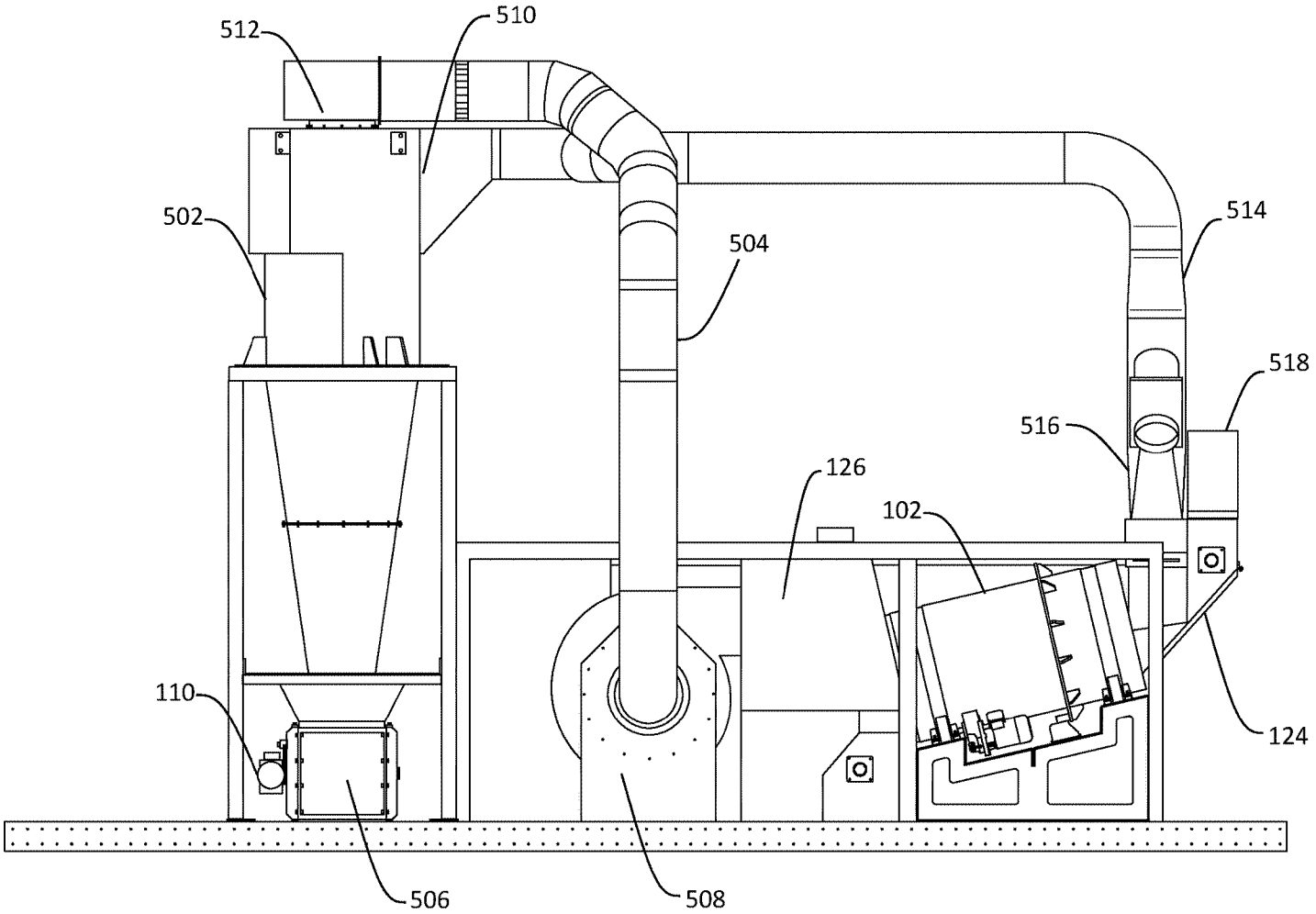
FIG. 5 is an elevation view of the rotating suction chamber apparatus.

Shown in FIG. 5 is an overview of an embodiment of the rotating suction chamber apparatus. Referring also to FIG. 1, a material feed 518 is linked to the material intake 106 in the upper housing 124 attached to the drum 102. A suction hood 516 at an elevation higher than the upper end 112 of the drum 102 connects to the light fraction outlet 108. A light separator shaft 514 with a substantially vertical portion rises from the suction hood 516. The light separator shaft 514 is ducted to an intake 510 in a conical separator 502. An air recirculation shaft 504 is ducted from an exhaust 512 in the separator 502 to an air blower 508 connected to the lower housing 126. A light fraction receptacle 506 is attached below the separator 502 and includes a gate valve 110. This creates a closed-loop system for the recirculation of air, and the gate valves 110 reduce emissions, reduce the need to install filters, reduce odors, and prevent material from blowing out.

Figure 6A:
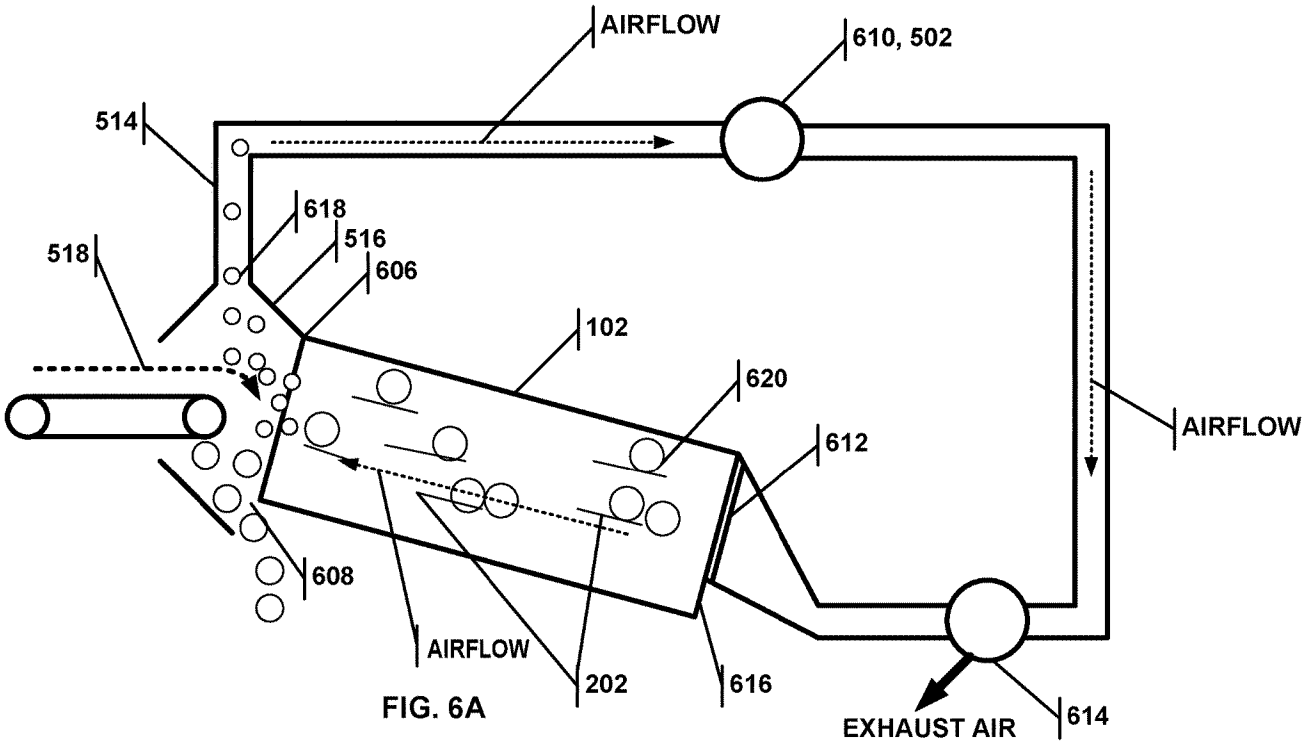
FIG. 6A is a schematic of the rotating suction chamber apparatus.
Figure 6B:
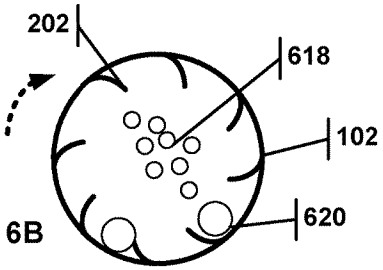
FIG. 6B is a cross section of the drum showing the flights.

FIG. 6 illustrates the flow of mixed recyclable material and air through an embodiment of the rotating suction chamber apparatus during operation. Referring also to FIGS.

1 and 5, the material feed 518 provides unsorted material consisting of a light fraction 618 and a heavy fraction 620 to the drum 102 via the material intake 106 in the upper housing 124. The gate valve 110 in the upper housing 124 functions to prevent material from blowing out and allows for recirculation of air.

The suction hood 516 pulls air from the drum 102 into the upper housing 124 as the air blower 508 circulates air into the lower housing 126. A last chance suction gate 616 and a seal plate 612 on the lower end 114 and a seal ring 606 at the upper end 112 help to channel the desired air circulation and aid in separation of materials. As air flows from the lower end 114 toward the upper end 112, the motor 120 drives the wheels 116 to rotate the drum 102 about its longitudinal axis. When the drum 102 rotates, the flights 202 continually raise the unsorted material and drop it into the air stream, breaking apart composites and unlayering layered items to separate the heavy fraction 620 from the light fraction 618. The heavy fraction 620 falls down the drum 102 from the upper end 112 to the lower end 114, encouraged by flights 202 which are helical in one embodiment, and drops out of the drum 102 at the heavy fraction outlet 122. The gate valve 110 at the lower end 114 functions to prevent material from blowing out and allows for recirculation of air.

Meanwhile, the light fraction 618 is sucked in the opposite direction by the airflow to rise through the light fraction outlet 108. The light fraction 618 is pulled through the suction hood 516 into the substantially vertical portion of the light separator shaft 514 and flowed to the conical separator 502, entering via the intake 510. An air lock 610 or similar device within the separator 502 removes the light fraction 618 from the airflow. The light fraction 618 drops into the light fraction receptacle 506 where it may be removed. The gate valve 110 in the light fraction receptacle 506 functions to prevent material from blowing out and allows for recirculation of air. The airflow continues out of the separator 502 via the exhaust 512 into the air recirculation shaft 504, and returns to the air blower 508.

A "medium" cut may also be achieved within the rotating suction chamber apparatus. The light fraction 618 is lifted out through the suction hood 516, while the heavy fraction 620 falls out the lower end 114 of the drum 102, as previously described. By adjusting the recirculation of air, a medium or mid fraction can be made to fall out of a medium fraction outlet 608 in the upper end 112. This allows larger items, and items not normally moved by suction, to be separated within the drum 102. If the three-cut rotary suction chamber apparatus was used on typical single stream fines, shredded paper and dust would move in the light fraction, glass would be the heavy fraction, and plastic bottle caps would be the mid fraction, for example. Additionally, this technique could be used on larger-sized items, such as a mixed waste stream including concrete, bricks, and other inert material; organics; and light fiber and plastics. The organics would then be the mid fraction white the light fiber and plastic sort with the light components and the concrete and inert material with the heavy components.

Further, moving air in a closed loop, with vertical airflow separation, has several advantages. First, this allows for capture and containment of fine particulate rather than blowing it into the atmosphere. This is important because solid waste particulate can contain bio-hazard (bio-aerosols) and other hazards such as glass dust. Second, using vertical airflow separation effectively separates the light fraction 618 that is moved into ducting and then removed from the airflow by normal means, such as a rotary air valve, cyclone, or air lock 610. Third, by re-circulating the air to the lower end 114 of the drum 102 as well as bleeding off a certain amount via an air gate 614, the movement of air into and out of the drum 102 can be precisely controlled. This allows the apparatus to achieve a medium cut or fraction separation, as the various outflows of air from the drum 102 can be designed such that only a certain amount of air goes into the ducting system, moving only ultra-light components and particulate. Fourth, using closed-loop vertical airflow separation, at the upper end 112 of the drum, allows the light fraction 618 to move at a much greater velocity. It remains airborne rather than migrating through the drum 102 as in prior devices. The primary constraint on the throughput of such a machine is how quickly it can remove the light, high volume fraction from the separation area. Thus, moving the liberated light fraction 618 quickly once it becomes liberated increases the throughput.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend that the following claims "and the embodiments in the specification to be strictly coextensive." *Phillips v. AHW Corp.,* 415 F.3d 1303, 1323 (Fed. Cir. 2005) (en bane).

The invention claimed is:

1. A rotating suction chamber apparatus for sorting a mixture of materials, wherein the mixture of materials comprises a light fraction and a heavy fraction, the apparatus comprising:

a cylindrical drum having an upper end and a lower end, wherein the upper end is at a higher elevation than the lower end;

an upper housing connected to the upper end, the upper housing having a material intake for receiving the mixture of materials for introduction to the upper end, wherein the upper housing comprises an outlet for the light fraction;

a suction hood connected to the light fraction outlet at an elevation higher than the upper end, the suction hood further comprising a light separator shaft with a substantially vertical portion;

an air blower adapted to create an airflow from the lower end, to the upper end, through the light fraction outlet and through the suction hood;

the suction hood is constructed such that the airflow lifts the light fraction away from the upper end through the substantially vertical portion;

a rotator constructed to rotate the drum about its longitudinal axis, whereby the heavy fraction is moved through the drum and falls out of the lower end;

a separator to separate the light fraction from the airflow, the separator having an intake and an exhaust;

an air recirculation shaft connected to the lower end; and wherein the light separator shaft is connected to the separator intake and the air recirculation shaft is connected to the separator exhaust, thereby allowing the airflow to circulate in a closed loop.

2. The rotating suction chamber apparatus of claim 1, further comprising a light fraction receptacle disposed beneath the separator.

3. The rotating suction chamber apparatus of claim 2, further comprising a gate valve disposed at the light fraction receptacle.

4. The rotating suction chamber apparatus of claim 1, wherein the upper housing further comprises a gate valve.

5. The rotating suction chamber apparatus of claim 1, further comprising a gate valve disposed at the lower end of the drum.

6. The rotating suction chamber apparatus of claim 1, the drum further comprising an inner wall having a plurality of flights for separating the light fraction from the heavy fraction as the drum is rotated.

7. The rotating suction chamber apparatus of claim 6, wherein the flights are helical.

8. The rotating suction chamber apparatus of claim 1, wherein the mixture of materials further includes a medium fraction and wherein the upper housing further comprises an outlet for removing the medium fraction.

* * * * *